United States Patent [19]

Doyel

[11] Patent Number: 4,497,580

[45] Date of Patent: Feb. 5, 1985

[54] TWO-MOTOR, BATTERY-OPERATED MIXER-POURER

[76] Inventor: John S. Doyel, 404 W. 20th St., New York, N.Y. 10011

[21] Appl. No.: 562,165

[22] Filed: Dec. 16, 1983

[51] Int. Cl.[3] ..... B01F 15/02; B67D 5/48; B67D 5/50

[52] U.S. Cl. ..... 366/190; 222/239; 222/385; 366/194; 366/251; 366/279

[58] Field of Search ..... 366/190, 194, 197, 199, 366/206, 241-251, 279, 292, 293, 325, 601; 222/239, 333, 334, 385; 415/122 R, 182

[56] References Cited

U.S. PATENT DOCUMENTS 3,289,897 12/1966 Ginsberg ..... 366/190
3,523,629 8/1970 Chi ..... 222/385
3,750,910 8/1973 Se-kit ..... 222/239
3,806,004 4/1974 Kolkovsky ..... 222/385

*Primary Examiner*—Timothy F. Simone

[57] ABSTRACT

Disclosed is a battery-operated utensil for mixing and pouring drinks and the like. It uses a separate motor to drive a shaft carrying mixer blades, and a separate motor to drive a pump. The motors are turned on one at a time, and drive the respective shafts directly, thus eliminating the use of components such as gears, clutches or ratchets. The design allows ingredients to be poured into the mixing vessel through a filling chute, without removing the housing which caps the vessel, as well as for convenient removal of the housing when necessary, as for cleaning. Various other features are provided to make the utensil particularly inexpensive to manufacture and convenient to use.

5 Claims, 12 Drawing Figures

TWO-MOTOR, BATTERY-OPERATED MIXER-POURER

BACKGROUND AND SUMMARY OF THE INVENTION

The invention relates to utensils for mixing and pouring drinks and the like. It is particularly directed to a utensil of this type which is inexpensive to manufacture and convenient to use.

Utensils of this general type have been proposed in the past; see, e.g., U.S. Pat. Nos. 3,289,897 and 3,750,910. The '897 patent proposes a combined agitator and fluid lifting device which uses the same motor and a gear/clutch arrangement for rotating either the liquid lifting mechanism or the agitating mechanism. The '910 patent similarly proposes using the same motor and a ratchet mechanism to actuate the agitator or the pump. The housing containing the motor has to be lifted from the mixing vessel in order to pour mixing ingredients therein.

In contrast, this invention provides a mixer-pourer which is believed to be more convenient to use in that the housing which caps the mixing vessel need not be lifted therefrom in order to introduce mixing ingredients. A filling chute, which also serves as a handle, extends outwardly from the upper part of the vessel's sidewall, and is normally capped off by a part of the housing but can be uncovered by simply rotating the housing relative to the mixing vessel. One motor is used for the mixing or agitating function, and a separate motor is used for the pumping function, and each is directly coupled to a respective driveshaft, thus eliminating the prior art need for gears and clutch arrangements. Indeed, no gears of any kind are used in a utensil embodying the invention, thus saving considerable manufacturing and assembly expense and improving reliability. Particularly simple but efficient arrangements are used for the agitating and pumping functions. Other advantages of the invention will become apparent from the detailed description below.

In a particular exemplary and nonlimiting example, the invention is embodied in mixer-pourer using an open top vessel and an open top, handle-shaped filling chute extending outwardly from the upper part of the vessel's sidewall and communicating with the vessel's interior. A removable housing caps the vessel and the chute. The housing contains a mixer motor and a pump motor, at least one but typically four batteries, e.g., C-cells, and a manually operable switching arrangement for turning on only a selected one of the two motors at a time. A mixer shaft is directly driven by the mixer motor and extends downwardly therefrom into the vessel, to a point near the vessel's bottom. A bottom mixer blade is affixed to the bottom end of the mixer driveshaft to rotate therewith, at least one but preferably two upper mixer blades are affixed to a higher part of the mixer driveshaft to rotate therewith. A spout extends outwardly of the housing and a pump conduit extends downwardly from the housing into the vessel and has a top end in fluid flow communication with the spout and a bottom end near the vessel's bottom. A pump is secured at the bottom end of the pump conduit, and a pump driveshaft is directly driven by the pump motor and extends downwardly therefrom to the pump. A brace is secured to the pump conduit and extends therefrom to the mixer driveshaft and has an opening in which it is journaled for rotation. The switching arrangement has a push button which normally is biased to a neutral position, in which both motors are off, but can be moved to a mixing position in which only the mixer motor is on, and a pumping position in which only the pump motor is on. The housing is manually rotatable relative to the vessel to uncover the filling chute while continuing to cap off the vessel itself, so that mixing ingredients can be introduced into the vessel through the filling chute. If need be, as for cleaning, the entire housing can be removed by simply lifting it up from the vessel.

DETAILED DESCRIPTION

Figure 1:
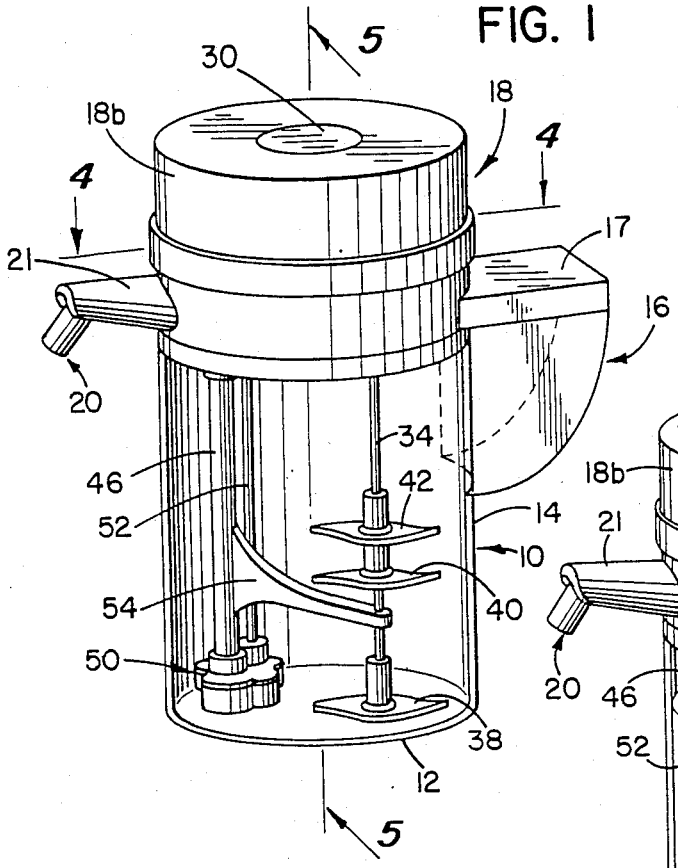
FIG. 1 is a perspective view of a two-motor, battery-operated mixer-pourer illustrating a nonlimiting embodiment of the invention.
Figure 2:
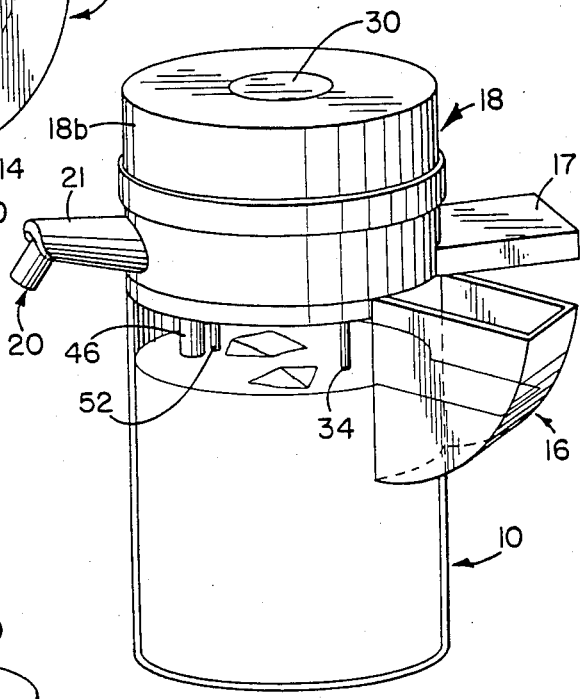
FIG. 2 is another perspective view illustrating the rotation of a housing relative to a mixing vessel to uncover a filling chute.
Figure 3:
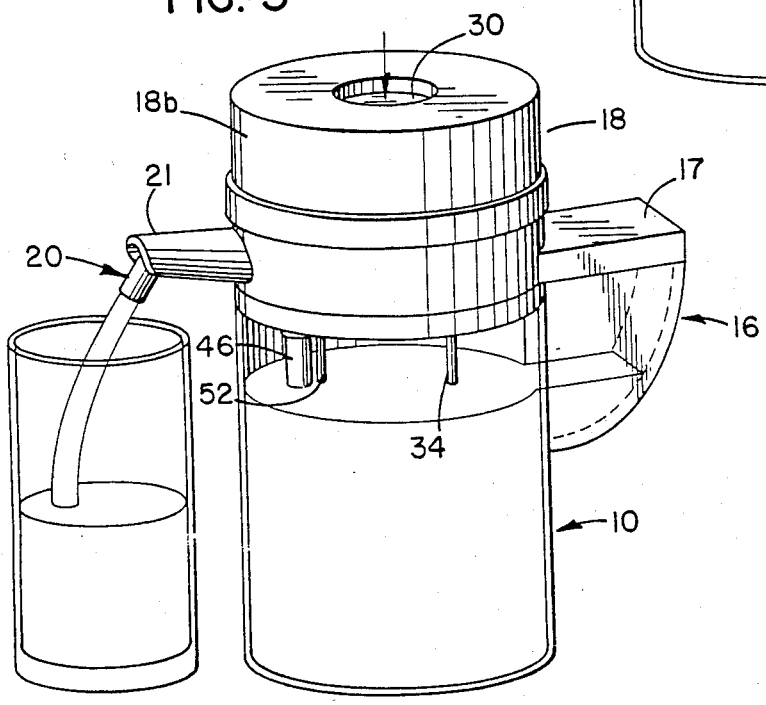
FIG. 3 is a perspective view illustrating pumping liquid from the mixing vessel into a glass.

Referring to FIG. 1, the utensil comprises a cup-shaped, open top vessel 10 having a bottom wall 12 and a sidewall 14 and an open top, handle-shaped filling chute 16 extending outwardly from the upper part of the sidewall 14 and communicating with the interior of vessel 10. A removable housing 18 caps vessel 10 and chute 16, and can be rotated relative to vessel 10, e.g., to the position illustrated in FIG. 2, to uncover chute 16 to allow mixing ingredients such as not only liquids but also ice cubes, to be introduced into vessel 10. After mixing, the contents of vessel 10 can be pumped out, as illustrated in FIG. 3, through a spout 20 which has a free end extending outwardly of housing 18. A spout cover 21 is secured to housing 19 and extends outwardly therefrom partway along the top surface of spout 20, to protect it and improve the appearance of the utensil.

Figure 4:
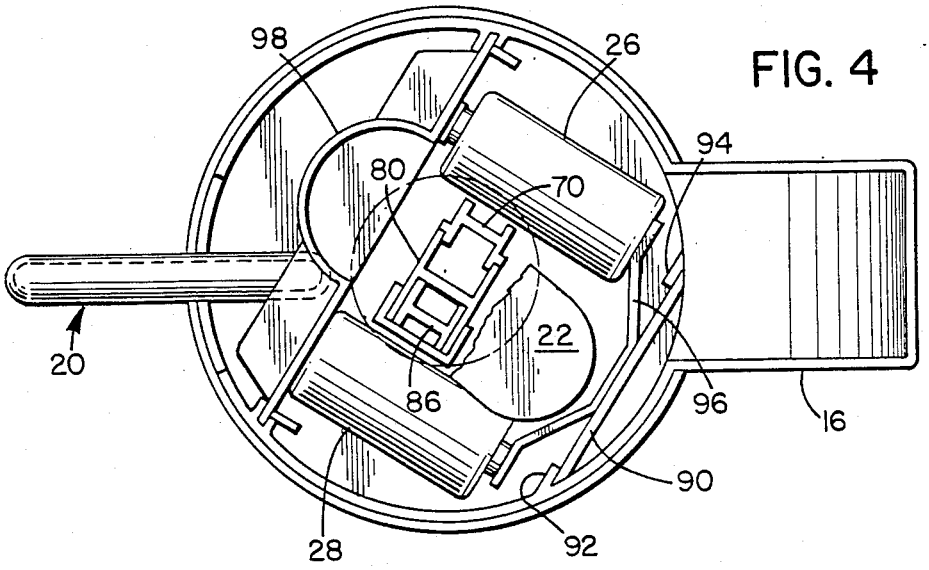
FIG. 4 is a sectional view taken along line 4—4 in FIG. 1.
Figure 5:
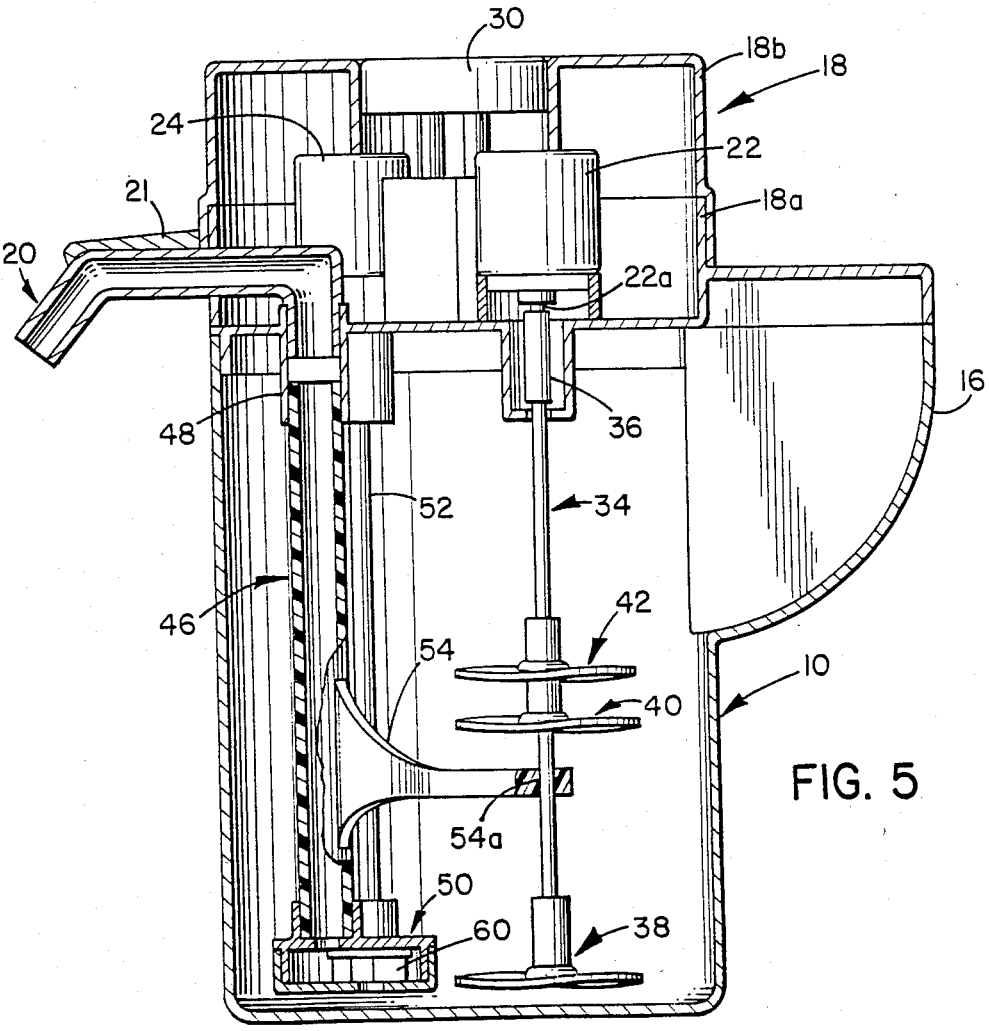
FIG. 5 is a sectional view taken along line 5—5 in FIG. 1.

Referring to FIGS. 4 and 5, the housing contains a mixer motor 22 and a pump motor 24, batteries of which 26 and 28 are visible, and a manually operable switching arrangement which includes a push button 30 (and other components to be described in more detail below) and serves to turn on only a selected one of motors 22 and 24 at a time. A mixer driveshaft 34 is connected to the shaft 22*a* of mixer motor 22, through a sleeve 36, to be directly driven thereby, and has affixed to its bottom end a bottom mixer blade 38. Affixed to an upper portion thereof are upper mixer blades 40 and 42. A pump conduit 46 extends downwardly into vessel 10 and has a top end in fluid flow communication with spout 20 (the connection being by means of a sleeve 48 which is an integral part of housing 18 and into which both the inner end of spout 20 and the top end of pump conduit 46 are inserted) and has a bottom end near the bottom of vessel 10. A pump 50 is secured at the bottom end of pump conduit 46 for pumping liquid from vessel 10 up through conduit 46 and out through spout 20. A pump driveshaft 52 is directly driven by pump motor 24, by being secured to the shaft thereof, in the same way as mixer driveshaft 34 is secured to the shaft of mixer motor 22. A brace 54 is secured to pump conduit 46 and extends therefrom to mixer driveshaft 34 and has an opening 54*a* in which mixer driveshaft 34 is journaled for rotation.

Figure 6:
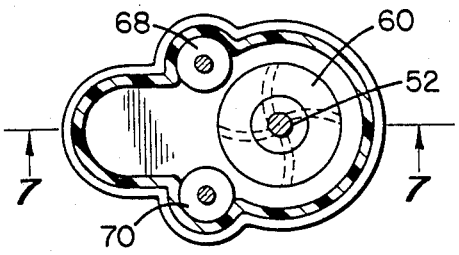
FIG. 6 is a partial sectional view of a pump taken along line 6—6 of FIG. 7.
Figure 7:
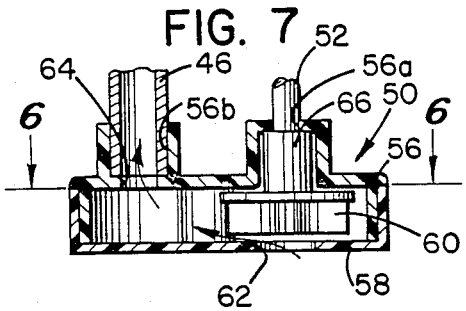
FIG. 7 is a sectional view taken along line 7—7 in FIG. 6.

Referring to FIGS. 6 and 7, pump 50 comprises an upper pump housing 56 mated as shown with lower pump housing 58 to form a chamber into which impeller 60 can rotate to draw liquid through pump housing inlet 62 and pump it out of pump housing outlet 64 into conduit 46. Pump driveshaft 52 enters the pump housing through an opening 56*a* and is affixed to impeller 60 through a sleeve 66 affixed thereto. Pump conduit 46 fits in a sleeve 56*b*, to be in fluid flow communication with pump outlet 64. Fastening devices 68 and 70 can be used to affix housing portions 56 and 58 to each other. For example, screws can be used as such fastening devices.

Figure 8:
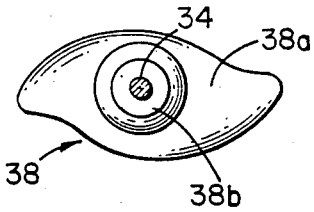
FIG. 8 is a bottom plan view of a mixing blade.
Figure 9:
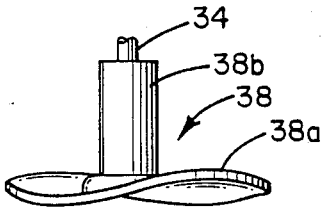
FIG. 9 is a side view of the mixing blade and its support sleeve.

Referring to FIGS. 8 and 9, mixer blade 38 comprises a blade portion 38*a* and an integral sleeve 38*b* affixed to mixer driveshaft 34, as e.g. by a frictional fit or an adhesive. It is believed that it is particularly advantageous for the purpose of this invention to shape blade portion 38*a* as illustrated in FIGS. 8 and 9. Upper blades 40 and 42 can be identical to blade 38 illustrated in FIGS. 8 and 9, and can be similarly affixed as shown to driveshaft 34.

Figure 11:
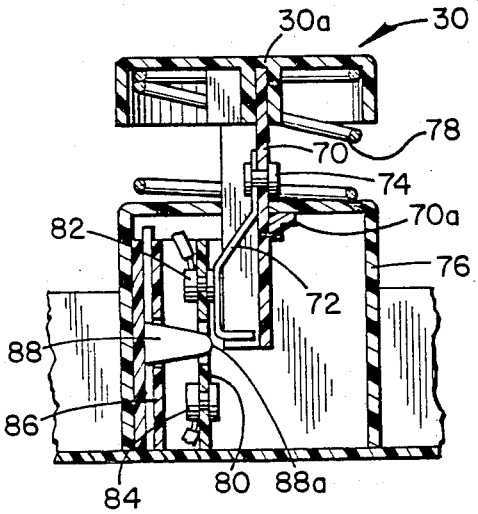
FIG. 11 is a sectional view of a portion of the switching arrangement.
Figure 12:
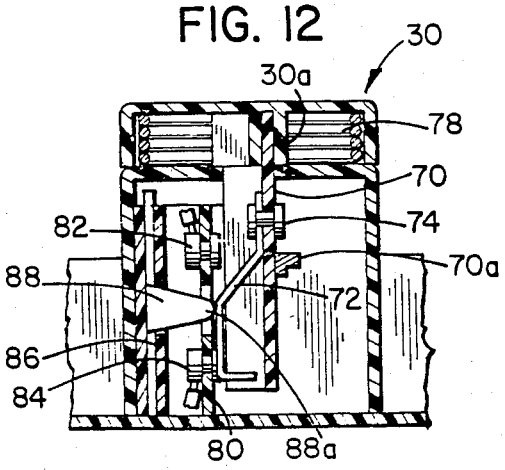
FIG. 12 shows the switching arrangement in FIG. 11 in a different switching position.
Figure 10:
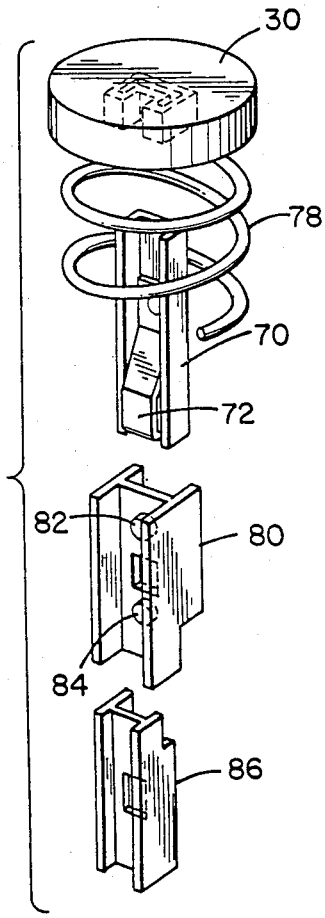
FIG. 10 is an exploded perspective view of components of a switching arrangement.

Referring to FIGS. 10–12, the switching arrangement comprises, in addition to push button 30, a channel section rod 70 which fits frictionally into mating channels 30*a* integrally formed as a part of push button 30 and carries a brass sliding contact 72 affixed thereto by means of an eyelet or a similar fastener 74. Rod 70 has an extension 70*a* which engages the top of a cap 76 affixed to housing 18 to limit the upward travel of push button 30, which is biased upwardly by a coil spring 70*a*. An I-section piece 80 is secured within cap 76, and has a top eyelet 82 electrically connected to mixer motor 22 and a bottom eyelet 84 electrically connected to pump motor 24. Also secured within cap 76 is another I-section piece, 86, which presses a fixed battery contact 88 against the sidewall of cap 76. Contact 88 has a loop extending through suitable openings in pieces 80 and 86 such that its tip 88*a* is at the same vertical plane as the righthand (in FIG. 11) portions of eyelets 82 and 84. Through wiring which is shown only in part, one side of batteries 26 and 28 is connected to fixed battery contact 88 and the other side to one of the contacts of each of motors 22 and 24. The other contact of motor 22 is connected to eyelet 82 and the other contact of motor 24 to eyelet 84. Thus, when push button 30 is in the neutral position shown in FIG. 11, both motors are turned off. When push button 30 is pushed down part way against the bias of spring 78, such that sliding contact 72 makes electrical contact between eyelet 82 and point 88*a* of fixed battery contact 88, the circuit for mixer motor 22 is completed, and the motor is turned on. However, in that position no contact is made with eyelet 84, and therefore pump motor 24 remains off. When push button 30 is pushed further down against the bias of spring 78, sliding contact 72 remains in engagement with fixed battery contact 88 but moves out of engagement with eyelet 82 before engaging eyelet 84. When it makes electrical contact between fixed battery contact 88 and eyelet 84 (as in FIG. 12), pump motor 24 is turned on, while mixer motor 22 remains off.

To make manufacture, and particularly assembly, of the utensil particularly inexpensive it is made primarily of molded plastic components which fit together with a minimum of fasteners. Vessel 10 and chute 16 are formed together, as one integrally molded unit of a plastic material such as ABS. The sidewall of vessel 10 is slightly conical to allow for such integral molding. Housing 18 is formed mainly of two integrally molded halves 18*a* and 18*b* which fit together as best seen in FIG. 5, and spout cover 21 snap-fits into bottom half 18*a*, e.g. by means of arrowhead barbs (not shown) integrally formed at the back end of cover 21 which snap-fit into mating openings (not shown) in the sidewall of bottom half 18*a* of housing 18. The various ribs, sleeves and flanges in housing 18 illustrated in the drawings are integrally molded as respective portions of its halves 18*a* and 18*b* to support the components enclosed by housing 18, to allow for a tight fit between the two halves of housing 18, and to allow housing 18 to fit in and be supported by the top of sidewall 14 of vessel 10. Chute cover 17 is integrally molded as a part of bottom half 18*a* of housing 18. A battery plate 90 (FIG. 4) friction-fits in the space defined by ribs 92 and 94 integrally molded as a part of bottom half 18*a* of housing 18, and has affixed to it a battery contact 96 which electrically connects batteries 26 and 28 in series. A terminal board 98 similarly fits in channels provided by respective ribs in bottom half 18*a* of housing 18 and carries various electrical terminals, not shown, for making connections needed for the switching arrangement for selectively turning on motors 22 and 24. Spout 20 is formed of two integrally molded halves which are secured to each other to form the spout as by adhesives or sonic welding. Similarly, conduit 46 and brace 54 is formed of two integrally molded halves, symmetrical about a vertical plane, which are similarly secured together as by adhesives or sonic welding.

I claim:

1. A two-motor, battery-operated mixer-pourer comprising:

an open top vessel having a bottom wall and a sidewall, and an open top, handle-shaped filling chute extending outwardly from the upper part of the sidewall and communicating with the interior of the vessel;

a removable housing capping the vessel and the chute and containing a mixer motor and a pump motor, at least one battery, and a manually operable switching arrangement for turning on only a selected one of said motors at a time, a mixer driveshaft directly driven by the mixer motor and extending downwardly therefrom into the vessel to a point near the vessel's bottom, a bottom mixer blade affixed to the bottom end of the mixer driveshaft to rotate therewith, at least one upper mixer blade affixed to a higher part of the mixer driveshaft to rotate therewith, a spout having a free end extending outwardly of the housing, a pump conduit extending downwardly from the housing and having a top end in fluid flow communication with the spout and a bottom end near the vessel's bottom, a pump secured at the bottom end of the pump conduit for pumping liquid from the vessel up through the conduit and out through the spout, a pump driveshaft directly driven by the pump motor and extending downwardly therefrom to the pump to drive it when the pump motor is on, and a brace secured to and extending from the pump conduit to the mixer driveshaft and having an opening in which the mixer driveshaft is journaled for rotation;

wherein said switching arrangement has a neutral position in which both motors are off, a mixing position in which only the mixer motor is on to rotate the driveshaft and thereby the mixer blades, and a pumping position in which only the pump motor is on to rotate the pump driveshaft and drive the pump to move liquid from the bottom part of the vessel up through the conduit and out through the spout;

and wherein said housing is manually rotatable relative to the vessel to uncover the filling chute and allow mixing ingredients to be introduced into the vessel without removing the entire housing and wherein, in the alternative, said housing can be completely removed from the vessel by lifting it therefrom, as for cleaning;

whereby mixing ingredients can be introduced into the vessel through the filling chute, when the housing is on the vessel but rotated relative thereto to uncover the chute, or ingredients can be introduced into the vessel with the housing completely removed therefrom, and whereby when the housing caps the vessel and preferably, but not necessarily, covers the chute inlet, the switching arrangement can be manually operated to turn on only the mixer motor to mix the ingredients and, after sufficient mixing, can be operated to turn on only the pump motor, to pump a desired amount of the vessel's contents up through the conduit and out through the spout.

2. A mixer-pourer as in claim 1 including a spout cover secured to the housing to extend outwardly therefrom partway along the top surface of the spout.

3. A mixer-pourer as in claim 1 in which the vessel and chute are integrally formed as a single unit of a molded plastic material, the spout is formed of two halves of molded plastic material secured to each other, and the pump conduit and brace are similarly formed of two halves of molded plastic material secured to each other.

4. A mixer pourer as in claim 1 in which the switching arrangement comprises a fixed battery contact flanked by a mixer motor contact on one side and a pump motor contact on the other, the last recited three contacts being along a common plane, and a sliding contact which has an electrically conductive portion in said plane that bridges the distance between one of said motor contacts and the fixed battery contact but not the distance between the two motor contacts, said sliding contact moving between a neutral position in which it makes electrical contact with the mixer motor contact but not with the fixed battery contact or the pump motor contact, a mixing position in which it makes electrical contact with both the mixer motor contact and the fixed battery contact but not with the pump motor contact, and a pumping position in which it makes electrical contact with the fixed battery contact and the pump motor contact but not the mixer motor contact, and said sliding contact being biased toward its neutral position.

5. A two-motor, battery-operated mixer-pourer comprising an open top vessel and an open top filling chute extending outwardly from the vessel and communicating with its interior, and a removable housing capping the vessel and the chute and containing a mixer motor and a pump motor, at least one battery, and a manually operable switching arrangement for turning on said motors selectively, a mixer driveshaft driven by the mixer motor and extending downwardly therefrom into the vessel, a bottom mixer blade affixed at the bottom end of the mixer driveshaft to rotate therewith, at least one upper mixer blade affixed at a higher part of the mixer driveshaft to rotate therewith, a spout having a free end extending upwardly of the housing, a pump conduit extending downwardly from the housing and having a top end in fluid flow communication with the spout and a bottom end, a pump secured at the bottom end of the pump conduit for pumping liquid from the vessel up through the conduit and out through the spout, a pump driveshaft driven by the pump motor and extending downwardly therefrom to the pump to drive it when the pump motor is on, and wherein said switching arrangement has a neutral position in which both motors are off, a mixing position in which only the mixer motor is on to rotate the mixer driveshaft and thereby the mixer blades, and a pumping position in which only the pump motor is on to rotate the pump driveshaft and drive the pump, said housing in addition to being removable from the vessel, being rotatable relative therewith while remaining on the vessel, to uncover the chute and allow mixing ingredients to be introduced into the vessel through the chute while the housing is on the vessel.

* * * * *